United States Patent [19]

Postema

[11] 4,000,639

[45] Jan. 4, 1977

[54] TOOL AND METHOD FOR TRUEING WHEEL RIMS

[76] Inventor: Leonard F. Postema, 2785 Northville Drive NE., Grand Rapids, Mich. 49505

[22] Filed: Apr. 8, 1975

[21] Appl. No.: 566,051

[52] U.S. Cl. ..... 72/316; 29/401 R; 72/390; 72/454

[51] Int. Cl.[2] ..... B21D 3/10

[58] Field of Search ..... 72/389, 454, 385, 386, 72/390, 705, 316; 29/401, 159 R

[56] References Cited

UNITED STATES PATENTS

| | | | |
|---|---|---|---|
| 1,139,878 | 5/1915 | McElroy | 72/454 |
| 1,355,713 | 10/1920 | Tench | 72/454 |
| 1,489,151 | 4/1924 | Prossen | 72/316 |
| 1,548,521 | 8/1925 | Fowler | 72/316 |
| 1,578,381 | 3/1926 | Baker | 72/454 |
| 1,647,211 | 11/1927 | Bushek | 72/316 |
| 1,822,407 | 9/1931 | Kennedy | 72/390 |
| 3,065,780 | 11/1962 | Romak | 72/316 |

*Primary Examiner*—C.W. Lanham
*Assistant Examiner*—Gene P. Crosby
*Attorney, Agent, or Firm*—Price, Heneveld, Huizenga & Cooper

[57] ABSTRACT

A tool and method for trueing damaged or bent areas of circular and other curvilinear rims such as wheel rims for bicycles, motorcycles, and the like either with or without tires on the rims. The tool includes a rim engaging flange for engaging an inside circumferential surface of the damaged, bent rim area. Lateral arms are provided for supporting a portion of the outer circumferential rim area adjacent the damaged, bent areas, and a wing nut for moving the rim engaging flange relative to the supporting lateral arms to true the bent area with respect to the supported area.

26 Claims, 7 Drawing Figures

TOOL AND METHOD FOR TRUEING WHEEL RIMS

BACKGROUND OF THE INVENTION

This invention relates to tools and methods for repairing circular and other curvilinear rims and, more particularly, to a tool and method for trueing damaged, bent areas of wheel rims such as those for bicycles, motorcycles, and the like.

The rims of wheels of bicycles, motorcycles, and other vehicles are often bent or damaged when the bicycle, motorcycle, or other vehicle is involved in an accident or a wheel strikes a curb, chuckhole, or other object. Such damage normally results in a flat area along its circumference. In the past, to repair such bends or flat areas, it has been necessary to completely remove the wheel including the rim from the bicycle or motorcycle, and also to remove the tire from the rim. Thereafter, in one method, the disassembled wheel was supported by its central axle and a strap or the like fastened about the damaged area. While the axle was held securely, the strap or the like was pulled outwardly to move the damaged portion.

It has recently been discovered, however, that such prior apparatus tended to stress many other parts of the wheel other than the damaged area. Such uncontrolled stress caused new bends or flat spots, preventing the wheel from being completely trued to its original circular condition, and even bending or breaking spokes which were previously undamaged. In addition, it was impossible to accurately gauge how far the damaged portion was being bent such that the wheel could be trued exactly. It was instead necessary to only roughly estimate how far the bent portion was pulled outwardly oftentimes resulting in inaccurate repairing of the rim.

The present invention was developed in recognition of and as a solution to the above problems.

SUMMARY OF THE INVENTION

Accordingly, it is an object and purpose of the present invention to provide a tool for trueing circular and othe curvilinear rims such as wheel rims for bicycles, motorcycles, and the like which allows the damaged rim to be repaired either when the wheel is on or off the bicycle, motorcycle, or the like and either with or without the tire remaining mounted on the wheel rim.

The tool includes apparatus for supporting at least one area of the rim circumference which is adjacent to the damaged, bent area such that other, undamaged portions of the wheel or rim remain unstressed while moving one of either the damaged rim area or the supported rim area relative to the other area. The tool thereby prevents damage to any other portion of the rim during repair of the damaged area.

Further, the tool allows the trueing and correction of bends either on only one laterial side or width portion of the rim or across the entire width of the rim. Bends which occur either directly over or inbetween spokes of the wheel can also be repaired. Although the tool can be manufactured in various sizes, one size of the tool can be used to true or repair generally all sizes and diameters of wheels when the tire is left mounted on the rim. The resiliency and flexibility of the tire absorbs any difference in size between the tool and rim being repaired. Also, the tool allows repair of rims without marring or scratching the areas being repaired.

In a broad aspect of the invention, the tool comprises extending means for engaging generally the inside circumferential surface of a damaged, bent area of a rim of the type having inside and outside circumferential surfaces. Support means are provided for supporting at least a portion of the rim adjacent the damaged, bent area, the support means including contact means for engaging a portion of generally an outer circumferential surface of at least one of either a rim or any tire supported on the outer circumference of such a rim. Further, means for moving one of the extending means and support means relative to the other are provided whereby the damaged, bent area is trued with respect to the supported area of the rim.

In narrower aspects, the tool includes arms supporting areas on either side of the damaged rim area being repaird, a bending member for engaging the damaged area, and drawing means for moving the bending member outwardly toward the support means.

In another aspect, the invention includes a method for trueing wheel rims and other rims of the type generally including inside and outside circumferential surfaces. The method includes supporting at least one outside circumferential area of a rim of the type described. The supported area is adjacent and on at least one side of a damaged or bent area of the rim. The inside circumferential surface of the damaged or bent area is engaged, and one of the engaged, damaged, or supported rim areas is moved with respect to the other of said areas until the damaged, bent area is trued with respect to the supported area.

These and other objects, advantages, purposes, and features of the invention will become more apparent from a study of the following description taken in conjunction with the drawings.

DESCRIPTION OF THE PREFERRED EMBODIMENT

Figure 1:
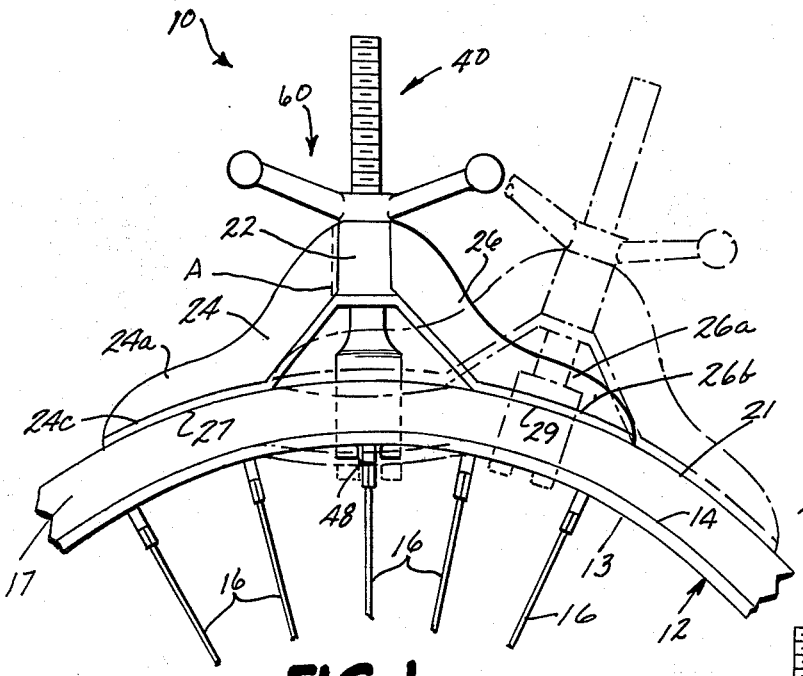
FIG. 1 is a fragmentary side elevation illustrating the present trueing tool mounted on a tire supported on a typical bicycle wheel rim in position to repair a flattened, bent portion of the rim.
Figure 2:
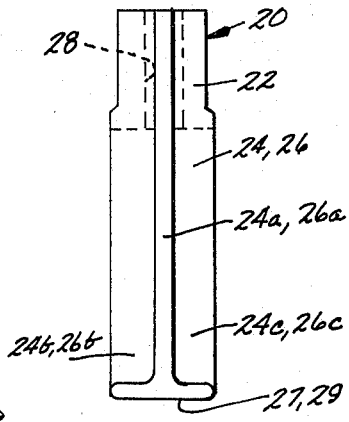
FIG. 2 is an end elevation of the rim or tire-engaging and supporting portion of the tool.
Figure 3:
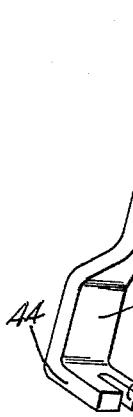
FIG. 3 is a perspective view of the bending member of the present tool.
Figure 4:
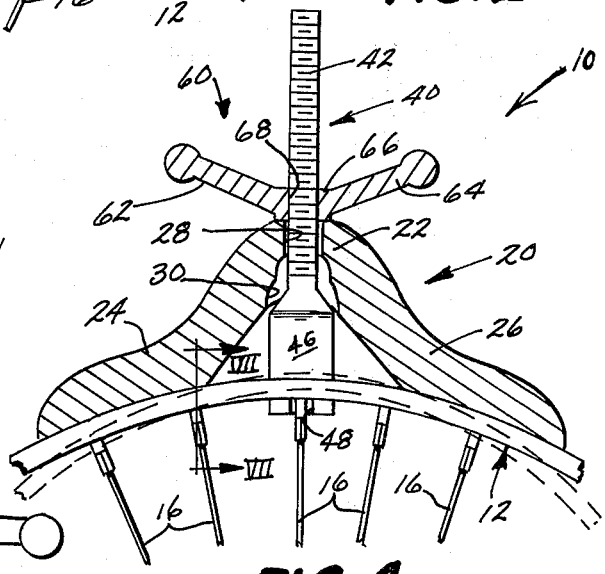
FIG. 4 is a fragmentary, sectional, side elevation of the tool positioned on a bicycle wheel rim with the tire removed.

Referring now to the drawings in greater detail, FIGS. 1, 3, and 4 generally illustrate the assembled rim repairing and trueing tool 10. The tool 10 may be used to bend and repair wheel rims such as those for bicycles, motorcycles, or other vehicles or machines with the wheel either left on the bike, vehicles, or machine, or removed therefrom, and either with or without a tire mounted on the circumference of the rim. The tool includes a one-piece support member 20 which engages either generally outer circumference surface of either a tire supported on a rim or an outer circumferential surface area of the rim itself. Support member 20 also positions and locates an extending, movable, bending member 40 extending therethrough for applying a bending force to the damaged area. A threaded wing nut 60 is provided for moving the bending member 40 outwardly, radially away from the center of the wheel and toward support member 20 in order to draw the damaged portion of the rim outwardly to its trued position.

Figure 5:
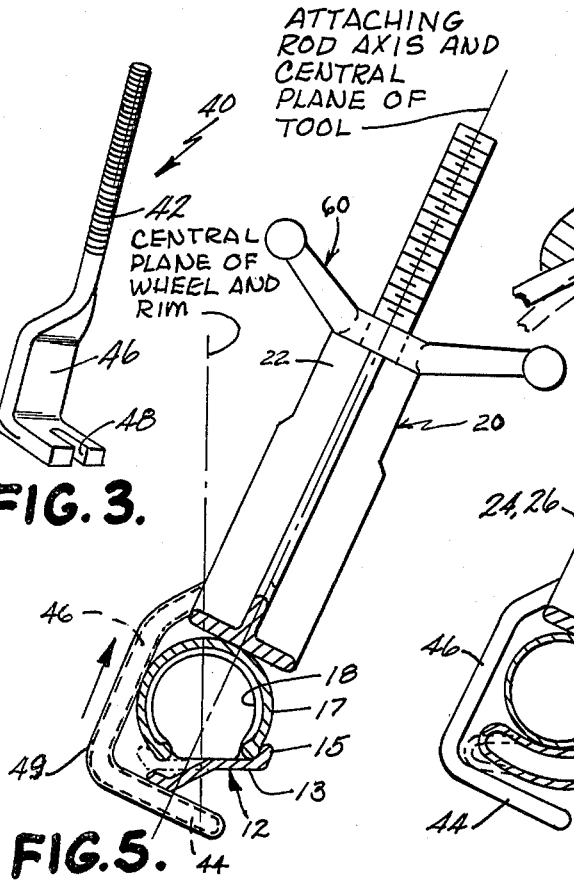
FIG. 5 is a sectional, end view of the tool positioned at an angle on a bicycle rim of the clincher type including a tire supported thereon, the tool being so positioned for bending and repairing damage to only one side of the rim.
Figure 6:
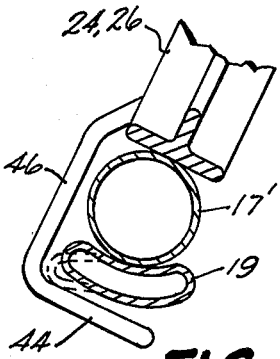
FIG. 6 is a fragmentary, sectional end view of the tool positioned on a bicycle rim of the tubular type including a tire supported thereon, the tool being so positioned for bending and repairing damge to only one side of the rim.
Figure 7:
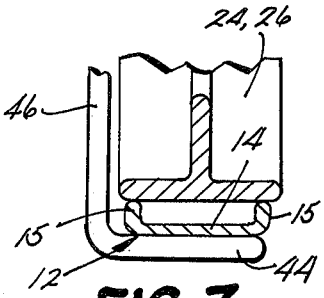
FIG. 7 is a fragmentary, sectional end view taken along line VII—VII of FIG. 4 illustrating the positioning of the tool on the lateral side flanges of a clincher rim having the tire removed.

In FIG. 1, tool 10 is shown positioned on a clincher type bicycle wheel rim 12 having an inside circumferential surface 13, an outside circumferential surface 14, as well as spaced, lateral, upstanding rim flanges 15 (FIGS. 5 and 7). The lateral rim flanges 15 provide lateral support for the bead and side wall portions of a tire 17 extending around the entire outside circumference 14 of the rim. A plurality of spokes 16 extend from the center or hub of the wheel generally radially outwardly and are secured in conventional manner to the inside circumferential surface 13 of the rim. Typically, tire 17 will include an inner tube 18 as shown in FIG. 5. Lightweight, tubeless racing tires 17' may be supported on tubular type rims 19 (FIG. 6).

As is best seen in FIGS. 1, 2, 4, and 5, support member 20 includes a central portion 22 and a pair of laterally extending arms 24 and 26 extending downwardly and outwardly from either lateral side of the central portion. The downward and outward extension of the arms supports the central portion 22 at a position spaced above the outer circumference 21 of the rim or tire when the tool supported on a rim thereby providing room for movement of the bending member 40 as will be described hereinafter. Each of the arms 24, 26 has the cross-sectional shape of an inverted T formed by integrally joined rib flanges **24*a*, 24*b*, 24*c*, and 26*a*, 26*b*, and 26*c*. Central portion 22 has the shape of a rectangular block including an aperture 28 extending completely therethrough from its top to an area on the bottom thereof intermediate the inside surfaces of arms 24, 26. Aperture 28 includes an enlarged, widened area 30 opening toward the bottom of the tool such that the larger portions of the bending member 40** may be received therein when necessary as described below.

Upstanding flanges **24*a*, 26*a* resist upward bending or bending away from the tire or rim when the tool is in use. Flanges 24*b*, 26*b*, and 24*c*, 26*c* extend in opposite directions from one another and provide supporting surfaces 27, 29 on the bottom of the arms 24, 26, respectively, for contacting the rim or tire. Supporting surfaces 27, 29 as formed by the bottoms of flanges 24*b*, 24*c*, and 26*b*, 26*c*, are curved at a predetermined radius along their length as shown in FIGS. 1 and 4. Such curvature allows the tool to mate generally with the outside circumference of either the tire or wheel rim. However, the width at each point along the length of surfaces 27, 29 is rectilinear a shown in FIGS. 2 and 5–7 such that the tool can accommodate various cross-sectional configurations of tires and rims and be positioned at an angle to repair damage to one lateral side of a rim when necessary as shown in FIGS. 5 and 6**.

As is best seen in FIGS. 1, 3, and 4, bending member 40 is generally elongated and includes a threaded attaching rod 42 extending upwardly from one end of a generally C-shaped portion including a rim-engaging flange 44 and a connecting portion 46 extending between rod 42 and flange 44. Connecting portion 46 is offset from the axis of the threaded attaching rod 42 such that the bending member extends around the wheel rim and any tire mounted thereon when the tool is positioned on the outside circumference of the rim or any tire mounted on a rim. Further, rim-engaging flange 46 extends generally perpendicularly and transversely of the central plane of the tool 10 (FIG. 5), which plane extends centrally through the support member and the laterally extending arms 24, 26. As shown in FIG. 5, the axis of attaching rod 42 is substantially aligned with the central plane of the tool when the bendng member 40 is received through aperture 28 in its operative position. This assures that the bending force from bending member 40 will be applied along the same plane in which the support for the undamaged rim portions is provided.

As shown in FIGS. 1, 3, and 4, rim-engaging flange 44 of bending member 40 is preferably forked and includes a slot 48 extending thereinto from its free end edge. Slot 48 receives one of the spokes 16 allowing the bending member to be centered exactly over any portion of a bend or damaged area of the rim. Further, the rim-engaging flange and connecting portion 46 of the bending member are preferably coated with a flexible, resilient coating layer 49 over all of their surfaces (FIG. 5) to prevent scratching or marring of the surfaces of the rim during repair. Preferably, such coating is a vinyl plastic or the like which may typically be applied by dipping the bending member in a heated, liquified quantity of the plastic.

As shown in FIGS. 1, 4, and 5, wing nut 60 includes a pair of arms 62, 64 extending outwardly from a central portion 66 which seats on the top surface of central portion 22 of support member 20. Central portion 66 of the wing nut includes an aperture 68 extending therethrough having threads matching those on the attaching rod of bending member 40. Thus, when attaching rod portion 42 of bending member 40 is threaded through aperture 68 of wing nut 60, wing nut 60 may be rotated about the top surface of the central portion 22 thereby moving bending member 40 toward and away from the supporting member 20 along the central plane of the tool as shown in FIG. 5.

In order to repair a damaged or bent portion of a wheel rim such as the clincher-type rim 12 (FIGS. 1, 4, 5, and 7), a lightweight, tubular-type, racing rim 19 (FIG. 6), or other rim types, tool 10 is positioned with its supporting surfaces 27, 29 engaging a pair of spaced, outer circumferential surface areas of either a tire 17 supported on one of the rims or across the upper edges of the lateral side flanges 15 of the rim. The total width of flanges **24*b*, 24*c*, and 26*b*, 26*c* is sufficient to extend across both flanges 15 of rim 17. When the damaged or bent area is small or short as shown in FIG. 1, the tool 10 is centered over the damaged area while bending member 40 is drawn outwardly and moved into engagement with the inner circumferential surface 13 of the damaged area. Typically, since the spokes 16 on a bicycle or motorcycle wheel exert a radially inwardly directed force to support the wheel on its central hub, any accident or striking or an object of chuckhole with sufficient force to damage the rim causes the rim to bend between two or more spokes thereby causing the bend to be centered over a spoke inbetween such spokes. Hence, as shown in FIG. 1, the tool is centered over the bent area and the spoke in the center of the area is received in slot 48 of rim-engaging flange 44. The several spokes in the immediate area of the damaged or bent portion are generously loosened or disconnected prior to positioning the tool 10. After trueing the spokes are tightened to their proper supporting tension. If the entire width of the rim is to be repaired, the central plane of the tool is centered on the central plane of the wheel and rim which is also the plane in which the wheel is normally rotated (see FIG. 5 for positions of planes). Thus, the inside surface of flange 44 contacts the entire width of the inside rim circumferential surface (FIG. 7). Thereafter, wing nut 60 is rotated such that bending member 40 is drawn outwardly along the central plane of the tool. The rim-engaging flange exerts a bending force against the inside circumferential surface of the damaged area while the engaging surfaces 27, 29 of lateral arms 24, 26** support spaced areas of the rim from the outside circumference adjacent and on either side of the area being repaired in opposition to the bending force. Only the damaged portion of the rim is involved in the repair bending operation with the tool stressing areas only immediately adjacent the area being repaired in order to allow trueing of the bent portion.

Normally, the bending member is drawn radially outwardly away from the central hub of the wheel until the damaged portion is exactly aligned in the same arc with the adjacent supported areas on either side thereof. Because of the natural resiliency of the typical steel, aluminum or other material used to manufacture rims 12 and 19, wing nut 60 is rotated a few turns past the actual trued position while the operator counts the number of extra turns used. Thereafter, the wing nut is rotated in the opposite direction to release the bending member and the natural resiliency of the material causes the previously damaged portion to spring back to an exactly trued position. Should the damaged portion, however, not be exactly aligned and trued, the wing nut can be again rotated the exact number of turns counted by the operator past the exact, trued position, turning the nut a few turns more and thereafter releasing the nut until the rim does spring back to its trued position. Thus, by counting the number of turns of the nut, the bending of the damaged portion can be gauged exactly to produce an exactly trued repaired wheel.

Should the damaged area be quite long, it can be bent in increments by moving the tool 10 from one end of the damaged area to the other in small steps in order to bend successive increments of the damaged area (see FIG. 1). The slot 48 in the rim-engaging flange 44 allows the tool to be positioned over virtually any portion of the damaged area even when centered directly over a spoke. Further, the extending arms 24, 26 support consecutively spaced areas adjacent each incremental step of the damaged portions to be repaired such that stress remains localized at the actual area being bent or repaired in each incremental step.

Should the radius of the wheel be larger or smaller than the radius of the curved surfaces 27, 29, the damaged rim is preferably repaired with the tire on the rim. In this case, the natural resiliency and flexibility of the tires, which are typically air-filled or pneumatic, allows the tire to flex and absorb any difference in radii between the tool and rim to be repaired such that the adjacent areas on either side of the damaged area remain firmly supported by the tool during operation. The typical bicycle or motorcycle tire pressure of 30 to 70 pounds per square inch is more than adequate to support the bending force necessary to repair the rim when multiplied by the total area of support areas 27, 29.

As shown in FIG. 4, the tool may also be used to repair a rim without the tire being supported on the rim. In such case, the surfaces 27, 29 extend across the tops of lateral rim flanges 15 (FIG. 7) while the bending member is brought into engagement with the inside circumferential surface of the rim. Because the spacing in the radial direction between the bottoms of surfaces 27, 29 and the engaging surface of flange 44 is small when rims are repaired without tires being supported thereon, the enlarged portion 30 of aperture 28 in support member 20 is provided so that the bending member can be drawn outwardly a sufficient distance to bring the damaged area of the rim alone to its trued position as shown in FIG. 4. Also, the tool may be used to repair a rim with a different radius of curvature than the areas 27, 29 without a tire thereon as shown in phantom in FIG. 4. In such case, only a portion of support areas 27, 29 contact the outside circumferential rim or lateral flange surfaces with adequate support still being provided for bending and repair.

As shown in FIGS. 5 and 6, tool 10 may be positioned at an angle to the central or normal rotational plane of the wheel and rim in order to true and repair bends and damage which occur only in one laterial side or width portion of the rim and do not extend across the entire width of the rim. In such case, the rectilinear form the width of the engaging surfaces 27, 29 allows the tools to effectively grip portions of the outer circumference of the tire near the side walls of the tire while the connecting portion 46 of bending member 40 extends around the tire 17 and rim 12 bringing the rim-engaging portion 44 into engagement with only the damaged side of the rim (FIG. 5). A similar procedure may be used with tubular-type rims 19 shown in FIG. 6 when damage occurs to only one lateral side of such a rim.

Accordingly, the method for trueing wheel rims and other curvilinear rims or strips of a type generally including inside and outside circumferential surfaces will be understood to include the steps of supporting at least one outside circumferential area of a rim adjacent and on at least one side of a damaged or bent area of the rim. The inside circumferential surface of the damaged or bent area of the rim is engaged and either the engaged damaged area or the supported rim area is moved with respect to the position of the other of the areas until the damaged area is trued with respect to the support areas of the rim. The method is preferably accomplished by supporting a spaced pair of outside circumferential areas of either the rim itself or tire supported on the rim and engaging and drawing outwardly the inside circumferential surface of a damaged or bent area intermediate the supported areas until the rim is returned to its trued condition. Specifically, the method may be performed with a tool of the type described above.

The method also includes repairing a damaged rim in an incremental step-by-step fashion, accurately gauging the bending and trueing of the rim by moving the damaged portion a predetermined distance beyond the actual trued position and allowing the material resiliency to spring the portion back to its exact, trued position, loosening and tightening spokes of the rim before and after repair, supporting the rim during bending, and repair either with or without a tire on the rim all as described above in conjunction with the tool 10.

Although the tool and method are described preferably as supporting a pair of spaced areas on either side of a damaged area, it is possible to support only one area on one side of the damaged area and bend the damaged area with respect to that single area. In such case, the tool would include only one arm 24 of 26 (i.e., by removing the tool portion to the left of line A in FIG. 1) and means for clamping or securing the end of that arm farthest from the bending member 40 to the rim or rim and tire. For large, damaged areas, the single armed tool is alternated from one end of the damaged area to the other progressing toward the middle of the damaged area.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are defined as follows:

1. A tool for trueing circular and other curvilinear rims such as wheel rims, such rims being generally of the type including inside and outside circumferential surfaces, said tool comprising extending means for engaging generally the inside circumferential surface of a damaged, bent area of such a rim when said tool is mounted on such a rim; support means for supporting at least a portion of the rim adjacent the damaged, bent area of the rim, said support means including contact means for engaging a portion of generally the outer circumferential surface of at least one of a rim and any tire supported on the outer circumference of such a rim; and position changing means for moving at least a portion of at least one of said exchanging means and support means relative to the other whereby said damaged, bent area is trued with respect to the supported area of the rim; said extending means including a rim engaging portion having aperture means therethrough for receiving a spoke of a wheel rim such that said rim engaging portion will simultaneously engage the inside circumferential surface of a wheel rim on either side of the spoke.

2. The tool of claim 1 wherein said rim engaging portion is the lower flange of a generally C-shaped portion adapted to extend around a wheel rim and any tire thereon when said tool is placed on a wheel rim; said extending means also including an attaching member extending outwardly from the upper flange of said C-shaped member for engaging said support means; said aperture means including a slot extending inwardly into said lower flange from one edge thereof.

3. The tool of claim 1 wherein said support means includes arm means for engaging a pair of areas spaced apart on either side of the damaged, bent area of a rim along said outside circumference of at least one of a rim and any tire supported on the outer circumference of such a rim.

4. The tool of claim 3 wherein said extending means includes a bending member; said position changing means including drawing means for moving said bending member, and thus the damaged, bent area of a rim, outwardly toward said support means.

5. The tool of claim 4 wherein said support means includes a central plane extending through said arm means and means for receiving and positioning said bending member in alignment with said central plane such that said drawing means moves said bending means and applies said bending force along said central plane.

6. The tool of claim 5 wherein said bending member includes said rim engaging portion, an attaching portion, and a connecting portion extending between said rim engaging and attaching portions; said rim engaging portion extending generally transverse to said attaching portion which is generally aligned with said central plane; said connecting portion being offset from said central plane such that it extends around the rim and any tire thereon when the tool is mounted on a rim.

7. The tool of claim 1 wherein said tool is adapted to engage a circular rim having a center; said position changing means include means for moving at least a portion of at least one of said extending and support means in a direction extending along a radius of the circular rim.

8. The tool of claim 1 wherein said extending means includes a bending member having a portion adapted to extend around at least a portion of one side edge of the rim from a position adjacent the outside circumference of the rim into engagement with the inside circumferential surface of the rim when the tool is mounted on the rim; said support means including locating means for positioning said bending member along a radius of the circular rim when said tool is mounted on such a rim.

9. The tool of claim 1 wherein said support means includes a curvilinear support bracket having a central portion and a pair of lateral, rim engaging arms, said central portion being joined to, supported by, and spaced above a damaged area of a rim of said pair of laterial rim engaging arms when the tool is mounted on a rim.

10. The tool of claim 9 wherein said central portion includes an aperture extending therethrough for receiving a portion of said extending means, said lateral arm engaging portions each including curved rim and tire engaging surfaces having a predetermined radius of curvature.

11. The tool of claim 10 wherein said extending means includes a bending member having an elongated, threaded attaching rod received through said aperture in said central portion, said rod having a rectilinear axis; a connecting flange having one end joined to said attaching rod and being offset from said rod axis for extending around the rim and any tire thereon when said tool is placed on a rim; and said rim engaging portion extending from an end of said connecting flange opposite said one end and extending transverse to said rod axis; said positioning changing means including a threaded wing nut seated against said central portion and threadedly receiving said threaded attaching rod for advancing said bending member toward and away from said central portion.

12. The tool of claim 1 in combination with a wheel rim of the type described and including a resilient, flexible tire extending around the outside circumferential surface of said rim; said support means including a pair of curved surfaces of a predetermined radius which engage portions of the outer circumferences of said tire adjacent a damaged rim area on either side thereof such that the resiliency and flexibility of said tire accommodates any difference in the radius of curvature of said rim and tire and said curved surfaces; said bending means including means for extending around and engaging generally the inside circumferential surface of said rim.

13. The tool and rim combination of claim 12 wherein said rim includes a central plane lying generally transverse to the axis of rotation for said wheel which passes through the hub or center of said wheel, said tool including a central plane passing through said support means; said bending means being aligned with said tool central plane such that the bending force is applied along and parallel to said tool central plane; said tool being positioned on said rim and tire such that its central plane is at an angle to said rim central plane whereby damaged and bent areas on only one side of said rim central plane can be trued with said tool.

14. The tool of claim 1 in combination with a wheel rim of the type described; said support means including a pair of curved support surfaces of a predetermined radius which engage portions of the outer circumferential surfaces of said rim adjacent a damaged area and on either side thereof; said bending means including means for extending around and engaging generally the inside circumferential surface of said rim.

15. The tool and rim combination of claim 14 wherein said rim includes a central plane lying generally transverse to the plane of rotation for said wheel which passes through the hub or center of said wheel, said tool including a central plane passing through said support means; said bending means being aligned with said tool central plane such that the bending force is applied along and parallel to said tool central plane; said tool being positioned on said rim such that its central plane is at an angle to said rim central plane whereby damaged and bent areas on only one side of said rim central plane can be trued with said tool.

16. A tool for trueing circular and other curvilinear rims such as wheel rims, such rims being generally of the type including inside and outside circumferential surfaces, said tool comprising extending means for engaging generally the inside circumferential surface of a damaged, bent area of such a rim when said tool is mounted on such a rim; support means for supporting at least a portion of the rim adjacent the damaged, bent area of the rim, said support means including contact means for engaging a portion of generally the outer circumferential surface of at least one of a rim and any tire supported on the outer circumference of such a rim; and position changing means for moving at least a portion of at least one of said extending means and support means relative to the other whereby said damaged, bent area is trued with respect to the supported area of the rim; said support means including a curvilinear support bracket having a central portion and a pair of lateral, rim engaging arms, said central portion being joined to, support by, and spaced above a damaged area of a rim by said pair of lateral rim engaging arms when the tool is mounted on a rim and including an aperture extending therethrough for receiving a portion of said extending means, said lateral arm engaging portions each including curved rim and tire engaging surfaces having a predetermined radius of curvature;

said extending means including a bending member having an elongated, threaded attaching rod received through said aperture in said central portion, said rod having a rectilinear axis; a connecting flange having one end joined to said attaching rod and being offset from said rod axis for extending around the rim and any tire thereon when said tool is placed on a rim; and a rim engaging member extending from an end of said connecting flange opposite said one end and extending transverse to said rod axis; said position changing means including a threaded nut seated against said central portion and threadedly receiving said threaded attaching rod for advancing said bending member toward and away from said central portion;

said rim engaging member being forked and including a central slot for receiving a spoke of a wheel rim such that portions of said rim engaging member will engage the inside circumference of a wheel rim on either side of a spoke.

17. A tool for trueing circular and other cirvilinear rims such as wheel rims, such rims being generally of the type including inside and outside circumferential surfaces, said tool comprising extending means for engaging generally the inside circumferential surface of a damaged, bent area of such a rim when said tool is mounted on such a rim; support means for supporting at least a portion of the rim adjacent the damaged, bent area of the rim, said support means including contact means for engaging a portion of generally the outer circumferential surface of at least one of a rim and any tire supported on the outer circumference of such a rim; and position changing means for moving at least a portion of at least one of said extending means and support means relative to the other whereby said damaged, bent area is trued with respect to the supported area of the rim; said support means including a curvilinear support bracket having a central portion and a pair of lateral, rim engaging arms, said central portion being joined to, supported by, and spaced above a damaged area of a rim by said pair of lateral rim engaging arms when the tool is mounted on a rim and including an aperture extending therethrough for receiving a portion of said extending means, said lateral arm engaging portions each including curved rim and tire engaging surfaces having a predetermined radius of curvature;

said extending means including a bending member having an elongated, threaded attaching rod received through said aperture in said central portion, said rod having a rectilinear axis; a connecting flange having one end joined to said attaching rod and being offset from said rod axis for extending around the rim and any tire thereon when said tool is placed on a rim; and a rim engaging member extending from an end of said connecting flange opposite said one end and extending transverse to said rod axis; said position changing means including a threaded nut seated against said central portion and threadedly receiving said threaded attaching rod for advancing said bending member toward and away from said central portion;

said aperture including an enlarged portion facing the wheel rim when said tool is mounted on a rim, said enlarged aperture portion adapted to receive a portion of said connecting flange therein such that said rim engaging portion can be moved into general alignment with said lateral rim engaging arms to allow sufficient movement of said bending means to use the tool on wheel rims both with and without tires supported thereon.

18. A tool for trueing circular and other curvilinear rims such as wheel rims, such rims being generally of the type including inside and outside circumferential surfaces, said tool comprising extending means for engaging generally the inside circumferential surface of a damaged, bent area of such a rim when said tool is mounted on such a rim; support means for supporting at least a portion of the rim adjacent the damaged, bent area of the rim, said support means including contact means for engaging a portion of generally the outer circumferential surface of at least one of a rim and any tire supported on the outer circumference of such a rim; and position changing means for moving at least a portion of at least one of said extending means and support means relative to the other whereby said damaged, bent area is trued with respect to the supported area of the rim; said support means including a curvilinear support bracket having a central portion and a pair of lateral, rim engaging arms, said central portion being joined to, supported by, and spaced above a damaged area of a rim by said pair of lateral rim engaging arms when the tool is mounted on a rim and including an aperture extending therethrough for receiving a portion of said extending means, said lateral arm engaging portions each including curved rim and tire engaging surfaces having a predetermined radius of curvature;

said extending means including a bending member having an elongated, threaded attaching rod received through said aperture in said central portion, said rod having a rectilinear axis; a connecting flange having one end joined to said attaching rod and being offset from said rod axis for extending around the rim and any tire thereon when said tool is placed on a rim; and a rim engaging member extending from an end of said connecting flange opposite said one end and extending transverse to said rod axis; said position changing means including a threaded nut seated against said central portion and threadedly receiving said threaded attaching rod for advancing said bending member toward and away from said central portion;

at least said connecting and rim engaging portions of said bending means including a resilient, protective coating layer adhered to all surfaces thereof to prevent marring or scratching of a rim being repaired with the tool.

19. A method for radially trueing wheel rims and other rims such rims being of the type generally including radially inside and radially outside circumferential surfaces, said method comprising the steps of:

1. accuately supporting at least one outside circumferential area at the periphery of a rim of the type described, said supported area being adjacent and on at least one side of a rim damaged or bent area of the rim which is being repaired;
2. engaging the inside circumferential surface of said damaged or bent area of the rim;
3. changing the position of one of said engaged, damaged area and said supported rim area with respect to the position of the other of said areas until said damaged, bent area is trued with respect to said supported areas of the rim.

20. The method of claim 19 including supporting a pair of outside circumferential areas of the rim, said supported areas being spaced apart from one another along said rim on either side of a damaged or bent area of the rim being repaired; said engaging step including engaging the inside circumferential surface of said damaged or bent area generally intermediate said spaced supported areas.

21. The method of claim 19 wherein said rim is supported by a plurality of spokes extending from a hub or center radially outwardly and engaging said rim; said method including loosening said spokes engaging the damaged area of said rim prior to trueing the damaged area as described; after which said spokes are tightened to the tension necessary to properly support the rim.

22. The method of claim 19 wherein the rim has a center, said step of moving one of said engaged, damaged areas and said supported area including drawing said engaged, damaged area radially outwardly away from the rim center with a tool.

23. The method of claim 22 including moving said tool along the damaged, bent area of said rim in steps in order to engage a series of adjacent bent areas of the rim and drawing said each of said areas outwardly while simultaneously supporting areas adjacent and spaced apart on either side of said engaged areas such that a large damaged area is gradually trued in a step-by-step manner.

24. The method of claim 22 wherein said rim includes a flexible, resilient tire extending around the outer circumference thereof; said step of supporting spaced areas of the rim including supporting a pair of outer circumferential surface areas of said tire while it is on said rim, said supported tire surface areas being spaced apart from one another along the outer circumference of the tire on either side of a damaged or bent area of the rim being repaired.

25. The method of claim 19 wherein said rim to be trued comprises a resilient, bendable material; said step of changing the position of one of said engaged, damaged and supported areas including accurately gauging the trueing of the rim by drawing said resilient, damaged area outwardly a predetermined distance beyond the actual position in which the rim is trued and releasing said area such that said resiliency of the material causes said damaged area to spring back inwardly to the actual trued position.

26. The method of claim 25 wherein said damaged area is drawn outwardly said predetermined distance beyond said actual trued position by rotating a threaded member engaging said tool while counting rotations of the member; releasing said member and damaged portions by loosening said member and checking said trueing for accuracy; and if the damaged area is still not trued, rotating said member a predetermined number of turns beyond the number of rotations previously made whereby the amount of bending of the rim for trueing is gauged exactly.

* * * * *

UNITED STATES PATENT AND TRADEMARK OFFICE

CERTIFICATE OF CORRECTION

PATENT NO. : 4,000,639

DATED : January 4, 1977

INVENTOR(S) : Leonard F. Postema

It is certified that error appears in the above-identified patent and that said Letters Patent are hereby corrected as shown below:

Column 1, line 44;
"othe" should be --other--;
Column 1, line 58;
"laterial" should be --lateral--;
Column 2, line 17;
"repaird" should be --repaired--;
Column 2, line 57;
"damge" should be --damage--;
Column 3, line 7;
After "either" insert --a--;
Column 3, line 64;
"a" should be --as--;
Column 4, line 67;
"or" (second occurrence) should be --of--;
Column 4, line 67;
After "object", "of" should be --or--;
Column 6, line 32;
"laterial" should be --lateral--;
Column 6, line 55;
"support" should be --supported--;
Column 7, line 43;
"exchanging" should be --extending--;
Column 8, line 40;
"of" (second occurrence) should be --by--;
Column 8, line 41;
"laterial" should be --lateral--;
Column 9, line 60;
"support" should be --supported--;
Column 10, line 19;
"cirvilinear" should be --curvilinear--;
Column 11, line 51;
"accuately" should be --arcuately--;

UNITED STATES PATENT OFFICE

CERTIFICATE OF CORRECTION

Patent No. 4,000,639 Dated January 4, 1977

Inventor(s) Leonard F. Postema Page 2 of 2

It is certified that error appears in the above-identified patent and that said Letters Patent are hereby corrected as shown below:

Column 11, line 54;

delete "rim" after "a".

Signed and Sealed this

Seventeenth Day of May 1977

[SEAL]

*Attest:*

RUTH C. MASON
*Attesting Officer*

C. MARSHALL DANN
*Commissioner of Patents and Trademarks*